US007294608B2

(12) United States Patent
Oldiges et al.

(10) Patent No.: US 7,294,608 B2
(45) Date of Patent: Nov. 13, 2007

(54) USE OF CALCIUM SULFONATE BASED THREADED COMPOUNDS IN DRILLING OPERATIONS AND OTHER SEVERE INDUSTRIAL APPLICATIONS

(75) Inventors: Donald Oldiges, Cypress, TX (US); Herschel McDonald, Red Oak, TX (US); Tom Blake, Spring, TX (US)

(73) Assignee: Jet-Lube, Inc. DE (US)

( * ) Notice: Subject to any disclaimer, the term of this patent is extended or adjusted under 35 U.S.C. 154(b) by 383 days.

(21) Appl. No.: 10/425,188

(22) Filed: Apr. 28, 2003

(65) Prior Publication Data

US 2004/0214732 A1 Oct. 28, 2004

(51) Int. Cl.
*C10M 135/10* (2006.01)
*C10M 125/00* (2006.01)

(52) U.S. Cl. ..... 508/390; 508/128; 508/148; 508/151; 508/169; 508/180

(58) Field of Classification Search ..... 508/390
See application file for complete search history.

(56) References Cited

U.S. PATENT DOCUMENTS 3,652,414 A * 3/1972 Bergeron ..... 508/119
4,597,880 A * 7/1986 Eliades ..... 508/401
5,084,193 A * 1/1992 Waynick ..... 508/528
5,093,015 A * 3/1992 Oldiges ..... 508/124
5,126,062 A * 6/1992 Barnes ..... 508/163
5,308,514 A * 5/1994 Olson et al. ..... 508/155
5,338,467 A * 8/1994 Olson et al. ..... 508/186
5,536,422 A * 7/1996 Oldiges et al. ..... 508/121
5,589,443 A * 12/1996 Denton et al. ..... 508/150
6,037,314 A * 3/2000 Kondo et al. ..... 508/363
6,679,526 B2 * 1/2004 Yamamoto et al. ..... 285/55
6,746,057 B2 * 6/2004 Goto et al. ..... 285/333

* cited by examiner

*Primary Examiner*—Ellen M. McVoy
(74) *Attorney, Agent, or Firm*—Robert W Strozier

(57) ABSTRACT

The present invention discloses the use of calcium sulfonate based greases compounds for use in application where the compounds are continuously, periodically or intermittently exposed to fluids that tend to contamination, erode, ablate or otherwise remove or interfere with the compounds ability to protect contact surfaces such as those present in threaded connections, and, especially in threaded connections associated with oilfield applications. The present invention also discloses methods for making and using such greases and compounds in application where the compounds are continuously, periodically or intermittently exposed to fluids that tend to contamination, erode, ablate or otherwise remove or interfere with the compounds ability to protect contact surfaces.

28 Claims, No Drawings

USE OF CALCIUM SULFONATE BASED THREADED COMPOUNDS IN DRILLING OPERATIONS AND OTHER SEVERE INDUSTRIAL APPLICATIONS

BACKGROUND OF THE INVENTION

1. Field of the Invention

The present invention relates to a thread compound composition including a calcium sulfonate base for use with threaded connections, especially threaded connections used in oilfield tool joints, drill collars, drilling strings, casing, tubing, line pipe, flow lines and subsurface production tools and in other severe condition industrial applications.

More particularly, the present invention relates to a thread compound including a calcium sulfonate base, where the compound has reduced loss due to interaction with drilling fluids during drilling operations for use on any threaded connection, but especially on threaded connections that are subjected to continuous or periodic contact with fluid that tend to remove, erode, chemical attack or ablate the compound coating threaded connections used in the oilfield or the like.

2. Description of the Related Art

Drilling muds have changed significantly over the last couple years due to environmental pressures and drilling in more extreme environments each year. These changes have resulted in degradation of conventional grease carriers due to chemical incompatibility. Extensive analysis of these muds with thread compounds and research and development into grease thickeners have resulted in new thread compound designs that adhere effectively to the threaded connections, to not degel at elevated temperatures, higher pH levels and aid in the galling resistance and corrosion resistance of this new series of products.

Current and past technology has incorporated such grease thickeners as calcium acetate complex, lithium complex, lithium stearate, lithium 12-hydroxystearate, anhydrous and hydrous calcium soaps, sodium soaps, organophyllic clays and silica. The thickener was typically selected for reasons of economics, performance or marketing advantage. Use of the new technology thickener has not been utilized, largely due to the high expense and until recent times offered no improved performance over cost advantage.

Technological improvements in the formula and optimizing process variables has resulted in the development of a grease base and product line that has no melting point, so applicable in high temperature service, and pH stability. The pH of drilling mud is increased as oil well depths increase and temperatures rise. pH stability, therefore, is imperative.

In certain applications, thread compounds are subject to severe erosion, ablation, or other removal processes, e specially when the threaded connections are continuously, periodically or transiently exposed to fluid that tends to remove the compound via circulation velocity and chemical attack. Erosion or removal is a particularly troublesome problem in the oil industry. During drilling operations, the threaded connections are exposed on a routine base to drilling fluids, which include drilling muds and shavings from the drilling operations. These fluids and/or shavings tend to dissolve, erode or ablate the compound removing the protection of the compound and increasing the likelihood of damage to the threaded connections during the engaging and disengaging process required due to repetitive drill bit replacement.

Thus, there is a need for a threaded connection compound with superior resistance to removal from exposure to fluid such as drilling fluids so that threaded connections that are continuously, periodically or intermittently exposed to such fluid do not expose the threaded connection to potential damage or catastrophic failure.

SUMMARY OF THE INVENTION

The present invention provides a composition including a calcium sulfonate base material for use in applications where the contacting surfaces such as threaded connections are subjected to continuous, periodic or intermittent contact with an active fluid, a fluid that tends to contaminate, remove, erode and/or ablate the compound from the contacting surfaces or otherwise tends to adversely affect the protective property of the composition to reduce galling, seizing and other damage to the contacting surfaces such as threaded connections. The composition can also include a thread protecting additive system having one or more boundary lubricants and one or more contacting surface protecting agent including metal flakes or powders, and/or finely divided non-metallic fibers and/or other additive or ingredient systems such as an anti-wear system and/or an anti-degradant system. The composition has improved properties for use in severe conditions such as in drilling operations.

The present invention provides a high performance over-based sulfonate grease carrier for controlled friction properties in oilfield drilling and production thread compounds.

The present invention also provides for the use of calcium sulfonate complex greases, over-based or neutral, in oilfield drilling and production thread compounds with controlled frictional properties.

The present invention also provides for the use of calcium sulfonate compounds with reduced thickener contents which are cost competitive with other compounds typically used in oilfield and petrochemical plant thread compound applications.

The present invention also provides a method for preparing the compounds of this invention.

DETAILED DESCRIPTION OF THE INVENTION

The inventors have found that high performance sulfonate greases represent superior carriers for controlled friction properties in oilfield drilling and production thread compounds, especially where those compounds are exposed on a continuous, periodic or intermittent basis to fluids that tend to remove, erode or ablate the compounds away from the threaded connection to which they were applied. The inventors have also found that the calcium sulfonate complex greases can be prepared in over-based or neutral formulation, each with application in oilfield drilling and production thread compounds with controlled frictional properties and in other application where the compounds are exposed on a continuous, periodic or intermittent basis to fluids that tend to remove, erode or ablate the compounds away from the threaded connection to which they were applied. The inventors have also found that by reducing the thickener content, a calcium sulfonate grease can be formulated that is cost competitive with other grease carriers currently used in oilfield and petrochemical plant thread compound applications.

The compounds can include a variety of other ingredients admixed into the calcium sulfonate complex grease or carrier including a thread protecting additive system comprising boundary lubricants, metal powders or flakes, and/or finely divided non-metallic fibers, an anti-wear additive system comprising one or more finely divided mineral additives designed to reduce surface wear during make-up and break-out provide specific, controlled frictional properties and an anti-degradant system for reducing the adverse effects of oxidation and ozonation on the composition.

The grease can be of the MIL G-6032 gasoline resistant plug valve lubricant type or other commercially available sulfonate greases for industrial lubrication, such as patents those lubricants described in U.S. Pat. Nos. 5,308,514, 4,560,489, 5,126,062 and 5,338,467 that contain a lower percentage of thickener with more oil.

The grease can then be compounded with solid fillers such as: (1) from about 5% to about 65% by weight of zinc dust that may also contain other fillers such as mica, talc, kaolin clay, graphite or other materials to limit plating of the zinc and modify the frictional properties such as described in the obsolete American Petroleum Institute Bulletin 7 A1; (2) solid fillers such as described in obsolete API Bulletin 5A2 for tubing, casing and line pipe; (3) fillers such as described in U.S. Pat. No. 5,348,668; and (4) fillers such as described in U.S. Pat. No. 5,536,422.

The grease can then be compounded to produce a tool joint and drill collar compound containing from about 1% to about 15% copper by weight, from about 2% to about 25% graphite by weight, as well as other friction modifiers or boundary lubricants such as $MoS_2$, talc, mica, zinc or lead.

The grease solid fillers can also contain diluent oil to attain required consistency for optimum adhesion to threaded connections. The above formulations can also include polymers to improve adhesion and/or water resistance, anti-oxidants and anti-rust or anti-corrosion additives.

The calcium sulfonate complex thickener grease can be petroleum oil or synthetic fluid based or mixtures of both to suit specific applications. The calcium sulfonate complex can contain lesser amounts of other thickener type greases with an expected drop in optimum performance, particularly when used in application utilizing fluids such as muds having a pH greater than about 9.0.

This patent does not purport that dramatic improvement to performance properties such as galling resistance, etc. of the solids occurs in non-mud applications. This patent provides a novel approach to protecting threaded connections in environments where drilling muds or other fluids to which the compounds are exposed exceed pH levels of 9.0 and improved adhesion in both water and oil based drilling muds due to the higher thickener content than found in conventional greases used in these applications up to this point.

The base material or grease useful in the compounds of the present invention includes a grease including a majority of calcium sulfonate complex as the agent that imparts resistance to contamination and/or removal by exposure to active fluids such as drilling fluids or other fluids encountered in industrial applications, chemical plants, food processing plants, etc that tend to reduce the effective protection of contacting surface protecting compounds, especially fluids that have a pH greater than or equal to 7, preferably greater than or equal to 8 and particularly greater than or equal to 9. The calcium sulfonate base grease can be prepared by several different methods including mixing calcium sulfonate and calcium hydroxide with a variety of acids and oils to produce a grease base, mixing a calcium sulfonate precursor such as calcium hydroxide, calcium oxide or calcium carbonate with a sulfonated material to make calcium sulfonate in situ or a calcium sulfonate grease can be purchased pre-made from producers such as Phillips, ExxonMobil, American Refining (Kendall), Whitmore, Century, Sinclair Oil Corp., Royal Lubricants (Royco), etc.

Regardless of the method for making the calcium sulfonate complex grease, the grease generally includes between about 60% and about 95% by weight of base oil based on the total weight of the grease and between about 40% and about 5% by weight of calcium complex based on the total weight of the grease. Once the base grease has been prepared, it can be used as the base or carrier for preparing thread compounds by adding other ingredients to the grease such as boundary layer materials, friction adjusting materials, or other additives as set forth in this application.

Design and Perform Considerations for Thread Compounds for Use in Continuous Flow Mud Systems Designing a pipe thread compound (pipe dope) for a continuous flow mud system for oilwell drilling is a difficult task, and requires knowledge of pertinent mechanical, chemical and temperature conditions that exist in normal drilling applications as well as extrapolated conditions associated with make-up and break-out of the drill pipe. These include the physical effects of the mud flowing across the doped pin and pipe surfaces, the chemical compatibility of the dope and mud system, and the frictional effect of the entrainment of the drilling fluids into the dope on the torque required to achieve the proper bearing stresses at the connection thread flanks and shoulders.

When threads engage, thread compounds undergo particle shear or mixing. If a mud is present, it is mixed into the thread compound during engagement. The higher the solids in the mud (barite, etc.), the more likely it is for significant entrainment of contamination into the thread compound due to particle shear during connection engagement. The softer the thread compound, the easier it is for mud to blend into it or to displace it from the connection surface. As the pH increases from neutral to about 9.5 or higher, the easier the grease thickener ("soap" or complex) bonds are attacked causing the grease to degel or melt away. This allows metal-to-metal contact to occur resulting in significant variations in required make-up and breakout torques. The degree to which these factors combine can result in wide swings in the frictional performance of the thread compound, mud and connection assembly. Unpredictable torques can be catastrophic in drilling applications with end results being belled boxes, stretched or broken pins, galled connections and string separations.

Standard drilling applications require a pipe thread compound to be in the NLGI grade of about 1 to about 1½. Stiffer grades (2 and above) result in the grease being more cohesive than adhesive when using standard dope brush application techniques. During engagement, the softer material (mud or dope) is more likely to be displaced. For a thread compound to work under this continuous drilling application, the thread compound must be sufficiently stiff so that a greater amount of mud or drilling fluids is displaced from the threaded connections during engagement, minimizing a level of mud contamination of the thread compound. Thus, the thread compound and application procedures must be designed to force the dope (thread compound) onto the connection surface.

One approach was to stiffen or thicken the thread compound. However, thickening by itself was not sufficient due to the chemicals present in the mud. The high mud pH required much time and effort in the development of a grease base having improved resistance to mud surfactants and pH than available in conventional or current complex soap thickened products.

The approach of thickening the compound, utilizing high pH and surfactant resistant base greases, and an effective application method results in a product that exhibits less change in frictional properties and retention of film strength (providing galling resistance) when subjected to continuous mud flow conditions. Since mud variables (solids and fluids content, level of cutting fines) can present a significant change in frictional performance, it may be necessary to utilize bench top test equipment to test frictional characteristic changes in the mud/dope system periodically to ensure the connections are made up optimally for the drilling application (such as highly deviated holes, high temperatures, high pH muds, etc.). The thread compounds prepared using a calcium sulfonate base grease of this invention results in minimal mud absorption thus reducing mud contamination effects on the thread compound, results in more consistent rig floor make-up, break-out and results in reduced down-hole make-up, wobble, etc.

Preferred organic thickener or thixotropic base materials include a major amount of calcium sulfonate soaps or calcium sulfonate complexes dispersed in a base oil or hydrocarbon fluid. Although the thixotropic base materials contain a major amount of calcium sulfonate soaps or calcium sulfonate complexes, the thixotropic base material or grease could include minor amounts of other metallic soaps or complexes including aluminum complex, lithium complex or mixtures thereof with reduced effect. The large amount of calcium sulfonate complex in the base grease is required to impart to the thread compound high melt points, excellent water resistance and excellent resistance to the adverse affects of being in continuous, periodic, or intermittent contact with fluids such as drilling fluids.

Generally, organic thickener thixotropic base materials comprise from about 10 wt. % to about 30 wt. % of a calcium sulfonate soaps and/or complexes and from about 90 wt. % to about 70 wt. % of one or more oils as described below. The thixotropic base material or grease preferably has the following properties: a density in lbs/gal of about 7.85 to about 8.40 and a Pen 25° C. of about 300 to about 320.

Suitable base oils include, without limitation, synthetic fluids, petroleum based fluids, natural fluids and mixtures thereof. The fluids of preference for use in the thread compounds of the present invention have viscosities ranging from about 5 to about 600 centistokes at 40° C. While fluids with viscosities between about 5 and about 600 centistokes 40° C. are preferred, higher viscosities fluids can be used as well and may be preferred in certain applications where a very thick compound is required. Preferred fluids include, without limitation, polyalphaolefins, polybutenes, polyolesters, vegetable oils, animal oils, other essential oil, and mixtures thereof.

Suitable polyalphaolefins (PAOs) include, without limitation, polyethylenes, polypropylenes, polybutenes, polypentenes, polyhexenes, polyheptenes, higher PAOs, copolymers thereof, and mixtures thereof. Preferred PAOs include PAOs sold by Mobil Chemical Company as SHF fluids and PAOs sold formerly by Ethyl Corporation under the name ETHYLFLO and currently by Albemarle Corporation under the trade name Durasyn. Such fluids include those specified as ETYHLFLO 162, 164, 166, 168, 170, 174, and 180. Particularly preferred PAOs include bends of about 56% of ETHYLFLO now Durasyn 174 and about 44% of ETHYLFLO now Durasyn 168.

Preferred polybutenes include, without limitation, those sold by BP/Amoco Chemical Company and Exxon Chemical Company under the trade names INDOPOL and PARAPOL, respectively. Particularly preferred polybutenes include BP Amoco's INDOPOL 100.

Preferred polyolester include, without limitation, neopentyl glycols, trimethylolpropanes, pentaerythriols, dipentaerythritols, and diesters such as dioctylsebacate (DOS), diactylazelate (DOZ), and dioctyladipate.

Preferred petroleum based fluids include, without limitation, white mineral oils, paraffinic oils, and medium-viscosity-index (MVI) naphthenic oils having viscosities ranging from about 5 to about 600 centistokes at 40° C. Preferred white mineral oils include those sold by Crompton Chemical Corporation, Citgo, Lyondell Chemical Company, PSI, and Penreco. Preferred paraffinic oils include solvent neutral oils available from Exxon Chemical Company, high-viscosity-index (HVI) neutral oils available from Shell Chemical Company, and solvent treated neutral oils available from Arco Chemical Company. Preferred MVI naphthenic oils include solvent extracted coastal pale oils available from Exxon Chemical Company, MVI extracted/acid treated oils available from Shell Chemical Company, and naphthenic oils sold under the names HydroCal and Calsol by Calumet. The newer Group 2 and Group 3 oils can also use used in the compositions of this invention.

Preferred vegetable oils include, without limitation, castor oils, corn oil, olive oil, sunflower oil, sesame oil, peanut oil, other vegetable oils, modified vegetable oils such as crosslinked castor oils and the like, and mixtures thereof. Preferred animal oils include, without limitation, tallow, mink oil, lard, other animal oils, and mixtures thereof. Other essential oils will work as well. Of course, mixtures of all the above identified oils can be used as well.

Water resistance is particularly important in oilfield, mining or water well drilling operations. However, because of changing properties of drilling fluids and other fluids that bath threaded connections, standard complex greases such as aluminum or lithium complex thickened hydrocarbon fluids or greases are unstable under these condition. Surprisingly, calcium sulfonate base greases show extraordinary and unexpect superior characteristics and properties as described in the Experimental Section below.

The base calcium sulfonate greases of this invention, whether made or purchased, can be subsequently mixed with other ingredients to produce sealants, thread compounds, anti-seize compounds or the like. Such ingredients include boundary lubricants, finely divided fibrous materials, metal powders and/or flakes, anti-degradants, or the like.

The boundary lubricants suitable for use in the present invention include, without limitation, graphites, calcium compounds such as carbonates, sulfates, acetates, fluorides, etc., other nonabrasive mineral compounds such as silicates, acetates, carbonates, sulfates, fluorides, etc., and mixtures thereof.

The finely divided fibers suitable for use in the present invention include, without limitation, synthetic polymeric fibers, non-abrasive mineral fibers, natural fibers, carbon or hydrocarbon fibers and mixtures thereof. Suitable synthetic polymeric fibers include, without limitation: polyamides such as nylon, kevlar™, aramid, and the like; polyimides; polyesters such as PET and the like, polycarbonates, carbon and carboncous, and the like and mixtures thereof. Suitable natural fibers include cellulose such as cotton and the like, modified cellulose and the like and mixtures thereof. Suitable mineral fibers include, without limitation, silicaceous mineral fibers and the like.

Suitable metal powders and/or flakes for use in thread compounds of this invention include, without limitation, copper, zinc, lead, nickel, molybdenum and aluminum.

Preferred metal flake include copper, zinc and nickel, with copper being particular preferred.

The present invention can preferably further includes an anti-wear additive system. Suitable anti-wear additives include, without limitation, molybdenum disulfide, boron nitride, bismuth naphthenate, organic sulfur additives, and mixtures thereof.

The present invention may further contain other conventional additives such as rust inhibitors, antioxidants, and corrosion inhibitors. These additional additives can be blended into the thixotropic base material prior to compound preparation or added during compound preparation. Such additives are added to the thixotropic base materials or to final compositions using mixing procedures well-known in the art.

The composition of the present invention may be prepared by blending the ingredients together using mixing procedures well-known in the art. The components must be substantially homogeneously blended to provide optimum film integrity. For smaller quantities, blending may take place in a pot or drum. For large quantities, the composition may be blended by combining the components in a large kettle mixer and mixing them together to produce a substantially homogeneous blend.

The thread compounds prepared using the calcium sulfonate greases of this invention, generally, include from about 20% to about 60% by weight of a thixotropic base material, from about 5% to about 40% by weight of one or more boundary lubricants and about 0.1% to about 10% by weight of one or more finely divided non-metallic fibers. Additionally, the thread compounds of the present invention can include up to about 12% by weight of an anti-wear additive system and up to about 5% by weight of an anti-degradant system. The anti-degradant system can include an antioxidant, a rust inhibitor, and/or corrosion inhibitor. As indicated earlier, the present invention can generally contain solid blends such as described in API Bulletins 5A2 and 7A1, or patents such as 5,348,668, 2,543,741, etc.

Preferably, the present thread compounds can include from about 50% to about 80% by weight of a thixotropic base material, from about 10% to about 30% by weight of one or more boundary lubricants, and from about 0.2% to about 5% by weight of one or more finely divided fibers. Again, the present invention can include up to about 10% by weight an anti-wear additive system and up to about 4% by weight of an anti-degradant system.

Particularly, the present thread compounds can include from about 60% to about 80% by weight of a thixotropic base material, from about 15% to about 25% by weight of one or more boundary lubricants, and from about 0.2% to about 3% by weight of one or more finely divided fibers. Again, the present invention can include up to about 8% by weight an anti-wear additive system and up to about 3% by weight of an anti-degradant system.

The thread compounds of the present invention are prepared by mixing the ingredients in an appropriate mixer such as a vertical blender or other equipment well-known in the art for mixing lubricants. For thread compounds that include finely divided fibers, it is important to ensure that the non-metallic, finely divided fiber, which is generally available in a pulp form, is adequately dispersed in the compound. The necessity for adequate dispersion of the fiber normally requires that the fiber be pre-mixed in the thixotropic base material. Thus, the fiber is first broken by hand into small clumps and then mixed into the thixotropic base material in premix step. When mixing is done in a conventional vertical blender, about 4 wt. % of fiber is mixed with 96 wt. % of the thixotropic base material. The mixing is performed as a moderate mix speed of about 45 rpm with half of the thixotropic base for about 15 minutes and then at a high speed, usually at the highest practical speed of the mixer, for another at least 15 minutes. The pre-mix is then tested for fiber dispersion. If no visible clumps are seen, then the remaining half of the thixotropic base is added and mixed for another about 15 minutes. The main purpose of this pre-mix step is to ensure that the fiber is substantially and uniformly distributed throughout the final thread compound so that film formation and integrity is optimized. Of course, the pre-mix can also be done in colloidal mixers and other types of apparatus. Additionally, the pre-mix can be pre-strained to remove any non-dispersed fiber.

The fiber containing pre-mix is then added to the other ingredients in a standard blender, usually vertical. The compound is mixed for at least 30 minutes after ingredient addition to ensure homogeneity. Of course, shorter and longer mixing times can be used depending on the mixer speed and type. Moreover, and in particular, the blend can include from about 1 wt. % to about 18 wt. % copper, and from about 10 wt. % to about 50 wt. % graphite and other solid fillers.

EXPERIMENTAL SECTION

Example 1

This example describes the preparation of a calcium sulfonate base grease composition that can be used as the carrier or base grease for thread compound useful in oil, chemical or industrial sectors of the economy or in other applications where the compound is exposed to harsh conditions and especially where the compounds are exposed on a continuous, period or intermittent basis to fluids such as drilling fluids or the like.

To a washed down kettle reactor heated by a hot oil heater to 375° F. or less was added 1738 lbs of 400TBN calcium sulfonate. Next, the agitator and recirculation were turned on and 234 lbs of water was slowly added to the calcium sulfonate. After the water addition, 3280 lbs of base oil was slowly added, followed by the slow addition of 104 lbs of 12-hydroxy stearic acid, 104 lbs of dodecyl benzene sulfonic acid (DDBSA) and 245 lb of methanol, while the composition was being agitated and recirculated. After these ingredients were added the temperature was set to 145° F. and mixing and recirculating was continued for 90 to 120 minutes. The temperature must be carefully controlled so that the batch temperature does not exceed 155° F. which can ruin the grease.

After the 90 to 120 minute hold, the material thickened and to the thickened batch material was added 21 lbs of calcium hydroxide having an evaporation loss of about 50% with mixing and recirculation. After the addition of the calcium hydroxide, the temperature was raised to between about 180° F. and about 190° F. and the following materials were added with mixing and recirculation in the following order: 368 lbs of 12 HSA and 522 lbs of water. Next, the temperature is raised to 220° F. and 550 lbs of base oil was added. After the remaining base oil was added, the batch temperatures was raised to 360° F. and held at that temperature for about 30 minutes with mixing and recirculation to condition grease. After the 30 minute hold at 360° F., the heating system was turned off and cooling started with mixing and recirculation. Once a temperature of below about 180° F. was attained and the product milled @0.012 then a sample was pulled for infrared analysis. The total weight of the final product was 6489 lbs with 1011 lbs lost to evaporation. This grease can then be used as the base carrier for thread compounds, which generally have added to the grease boundary lubricants, friction adjusting additives, metal flakes or powders, finely divided non-metallic fibers, fillers, anti-degradants or the like.

Field Samples of Mud Contaminated Thread Compound and Associate Mud Tests

Field Sample Testing

A sample of mud used on at a rig site, using a conventional copper based thread compound manufactured by Jet-Lube, Inc. and sold under the tradename KOPR-KOTE®, was tested to determine a reported cause of failure of tool joint protection afforded by KOPR-KOTE®. Contamination from the drilling mud was a contributing factor in the pipe failure. Test results on the drilling mud from the site were as follows:

| | |
|---|---|
| Brookfield viscosity: | |
| Density: | 14.7 |
| pH: | 10 |
| Water %: | 6.85% |
| Acid Insoluble: | 49.33% |

-continued

| | |
|---|---|
| Solvent Insoluble: | 68.65% |
| Residual Hydrocarbon: | 6.73% |
| Volatile Matter: | 24.62% |

X-ray diffraction spectra run on the mud showed the possible presence of clay and barite, which were not adequately separate or differentiate by the X-Ray unit. FTIR analysis of the residue after conditioning at 110° C. showed a strong hydroxyl peak and other broad peaks between 400 and 1800 reciprocal centimeters typical of a carbohydrate type material, but the actual identity of the mud components was not determined.

From the testing, it is likely the high pH and surfactant type additives in the mud, coupled with the high level of contamination est. 65% of the mud in the thread compound caused the breakdown of the grease carrier.

Laboratory Testing of Mud Contamination in Thread Compounds

Thread compound from a rig operation was submitted for laboratory analysis to determine the effect of the mud on the frictional properties and film strength of the thread compound being utilized on the rig. The thread compound removed from the inspected connections did not have the typical consistency found with the thread compound as produced.

Approximately six ounces of thread compound/mud residue was removed from the inspected connections pulled from the string. The material looked like standard copper-based thread compound that had degelled. There was not sufficient sample to run a cone penetration test, but it appeared that the removed material would have a cone penetration in a range of about 370 to about 390, whereas the range typical for virgin thread compound is between about 300 and about 330. Tests were carefully planned to generate as much information as possible with the limited quantity of material available.

A sample of the mud followed a couple days later and its data is listed in this report as well. Listed below are the data obtained through testing along with data on a production sample of the copper-based thread compound (virgin compound) as a reference.

TABLE I

Physical Property Comparison Between Field Compound and Virgin Compound

| Physical Property | Field Compound | Virgin Compound |
|---|---|---|
| Appearance | Bronze Semi-fluid | Coppery Bronze Soft Paste |
| Specific Gravity | 1.43 | 1.16 |
| Density (lbs./gal.) | 11.9 | 9.65 |
| Cone Penetration | 370-390 est. | 315 |
| Dropping Point | 132° C. | 267° C. |
| Solvent Insolubles | 53.3 | 35 |
| Metals | 3.5% Copper, 3.62 Calcium, 0.51 Zn | Copper, Calcium, Moly |
| Acid Insolubles | 32.1 | 17 |
| pH | 8.5-9 | 7 |
| Water Solubility | Slight | None |
| Wt % Loss, 24 hrs, 110° C. | 14.4 | 1.2 |
| 4-Ball Weld Point | 315 Immediate | 1000 Immediate |
| Last Non-seizure | 250 kgf | 800 kfg |

Samples of the mud of the type utilized on the offshore drilling rig were received and mixed into virgin KOPR-KOTE® thread compound at 5%, 10%, 20% and 50% by weight. The density and penetration values were obtained to determine the affects of the mud on thread compound consistency at ambient conditions. These samples were then analyzed by x-ray diffraction and their frictional properties evaluated on the 4-Ball Extreme Pressure tester and on the API RP 7A1 bench top frictional test apparatus utilizing 1¾" tool joints. Finally, the samples were placed in an oven at 110° C. to test stability of the mud and the thread compound blends with temperature.

The frictional property evaluation using the small tool joint may not relate directly to the full scale tool joint because it does not exhibit the same relative surface movement (distance of travel) of the contact surfaces as a full-scale connection. More travel thins out the compound and can result in dramatic differences in frictional properties, much like what occurs with tubing and casing connections. Also different is the double-shoulder configuration of the premium connection design used. Also of note, in the field, the weight of the pipe in the stand can result in rather extreme loads initially on the stab flanks of the threads, whereas the lab test apparatus horizontal configuration starts with no real load. The test data was included, however, to show potential interaction and change in the thread compound. The relative friction factors were based upon the agreement by some API Subcommittee members that the lead reference compound is a 0.9 friction factor. Using a lithium complex based thread compound was also tested to determine whether the co-crystallized soap would be more stable when subjected to the surfactants and caustics in this mud than a complex with aluminum.

| Brookfield Viscosity | Weld Pt 4-Ball | | Initial Pen | Density | Drop Point | Friction Factor Slope | Friction Factor Turns | Post 100° C. Pen |
|---|---|---|---|---|---|---|---|---|
| | 1000 | KOPR-KOTE-Virgin | 310 | 9.65 | 267° C. | 1.09 | 1.23 | No Data |
| | 315 | KOPR-KOTE-GlomarJackRyan | >400 | 11.9 | <130° C. | 0.75 | 0.77 | Slop |
| | 800/1000 | KOPR-KOTE-LC | 303 | 9.55 | 274° C. | No Data | No Data | No Data |
| | 800 | KOPR-KOTE-5% Mud | 290 | 9.70 | 258° C. | No Data | No Data | 318 |
| 80,000 cp | 800 | KOPR-KOTE-10% Mud | 280 | 9.75 | No Data | 0.97 | 1.01 | 330 |
| 8,000 cp | 620 | KOPR-KOTE-20% Mud | 275 | 10.25 | No Data | 0.95 | 0.8 | Just Oil |
| 2,000 cp | 400 | KOPR-KOTE-50% Mud | 328 | 11.75 | 136° C. | 0.92 | 0.94 | Just Oil |
| | 500 | KOPR..KOTE-LC/50% Mud | 374 | 11.7 | 183° C. | No Data | No Data | 354 |

Based upon the data above, the thread compound with lithium complex holds up better with 50% contamination after conditioning at 110° C. than the standard thread formula. Initially, that did not appear to be the case since there was a large break or softening at room temperature when compared to the aluminum complex based thread compound which actually hardened with most of the blends. Since drilling does not occur at low/ambient temperatures, the data after the 100° C. conditioning has to be given greater significance.

The frictional properties using the 1¾" connection indicate the complaint sample had a much lower relative friction factor by both slope and by turns, in the order of 30% lower. Recent testing with a friction test method developed by Baker Hughes Inteq, Stress Engineering and Jet-Lube, Inc. using friction specimens discussed in the most recent API meetings shows at times conflicting frictional information from the small tool joint. The BHI test specimens model the same relative surface movement as a full-scale connection and also can be instrumented to measure the bearing load at the contact faces during make-up. This configuration gives a more accurate measurement of the relative frictional properties between compounds of widely varying compositions.

The remainder of the test sample was taken to Stress Engineering for evaluation on these BHI specimens. This was done to determine whether the frictional properties would be consistent with the tool joint or show opposing data. The data was reasonably consistent with the small tool joint. Standard thread compound had a slope of 10.7 and a load of 67,000 PSI at 600 foot-pounds of torque on the specimen whereas the contaminated sample had a slope of 7.4 (31% difference) and a load of 80,000 PSI (19% difference) at 600 foot-pounds.

It is still feasible that the breakdown found with heat may be influencing the frictional properties as both the test at Stress on the BHI specimen and the series of tests at Jet-Lube, Inc. were all run at room temperature. It must also be noted, however, that although softer, the complaint sample was not liquefied as was observed with the oven sample with 50% contamination. That could indicate the connection never saw temperatures high enough to result in severe degellation.

Mud Contamination Tests

Friction test results indicate that the mud contamination in KOPR-KOTE® samples lowered the Friction Factor and could result in over-torquing of the drill pipe connections. It should be pointed out that although these tests are performed at contact stresses that represent the average contact stress at the shoulders in a full-scale connection, they do not take into account the point or localized contact stresses that can occur in the connection (primarily on the thread flanks) during make-up and down-hole rotation. At lower contact stresses, the coefficient of friction due to mud contamination may indeed be lower but once the film strength or the load-carrying capability of the drilling fluid is exceeded the contact surfaces are now riding on the solids in the mud system which can include a substantial amount of cutting fines. These materials can be extremely abrasive and will result in a significant increase in the coefficient of friction and lead to galling and under-torquing of the connection. The low weld points in the Four-Ball test (high point contact stresses) and the galling that occurred in the new API procedure (higher contact stress, more relative surface movement) indicated that this was indeed the case with the mud-contaminated compound samples. The other factor could affect make-up if the box is completely full of mud, is the possibility of trapping the material in the thread area between the primary and secondary shoulders resulting in "stand-off" due to hydraulic pressure. Obviously, significant mud contamination introduces any number of constantly changing variables that will affect the torque required for proper make-up.

Attached is a copy of the final evaluation of the mud, the contaminated KOPR-KOTE® compound and the evaluation of the varying percentages of mud contaminated thread compound (with various types of base greases). The data indicated that the calcium complex base greases gave the most favorable properties. The use of calcium sulfonate greases coupled with the elimination of the drilling mud from the connection during the application of the thread compound and make-up of the connections significantly reduces the potential of mud contamination of the thread compound.

Mud Contaminated Thread Compound Tests

A large array of tests were run to evaluate the affects of the mud utilized on a Rig on different base greases available for thread compounds. Clay greases were not considered due to their extreme sensitivity to many chemicals. Tested were lithium complex (LC), aluminum complex (Std), economical calcium complex (CAB), extreme duty calcium complex (DBC) and an aluminum complex thickened castor oil grease (Castor Oil). The greases were all compounded individually into KOPR-KOTE® with cone penetration values between about 310 and about 330 mm×$10^{-1}$.

To determine how the mud affected the thread compounds, 0, 10, 20 and 50 percent blends were prepared. Density values were recorded, cone penetration and/or Brookfield viscosity, 4-Ball weld points and frictional properties were evaluated. Samples were also conditioned at 110° C. (2300P) to determine the affects of elevated temperature on the mixtures.

The mud was reported at a pH of 9.5 on the rig and analyzed in the lab at a pH of 10, not a statistically significant difference between labs, but higher pH levels act more exponentially than linearly with regard to grease thickener stability. A portion of the mud was also buffered down to a pH of 8.5 to determine whether a reduction in pH would improve the stability of the mud mixed with a aluminum complex based grease. A significant improvement would indicate pH was the primary cause of incompatibility. A minor improvement would suggest a surfactant might be the contributing cause of instability. Lowering the pH made an improvement, but at 50% contamination the blend lost viscosity. This indicated a component in the mud broke the hydrogen bonds in the aluminum complex micelle.

Based upon the data, the most compatible grease base with this type of mud and temperature is a calcium complex grease, where the difference in frictional properties is not statistically significant between the neat thread compound and a thread compound having a 50% mud contamination level. The film strength did drop, however, and that is still likely one of the most relevant data points based upon what is occurring on the rig. These values also do not show the potential variability contributed to formation cuttings in the mud.

In addition to the tests performed by the inventors, an outside laboratory was contracted to run two other friction tests. These test methods are being evaluated by an API Subcommittee for potential incorporation into RP 7 A1 standards. One test specimen set was evaluated to determine frictional properties; the other set was used in a method having a more narrow contact area, which taken to a higher contact stress creating a greater potential for galling. Both tests utilized a load cell to measure actual loads on the specimens.

In the first set of tests at the outside contractor, the thread sample provided similar results as found by the inventors. In the galling tests, the field sample failed after six runs, whereas virgin KOPR-KOTE® did not fail. The period for failure of the field same, however, was not consistent with what was being observed in the field. The severity of the problem in the field suggested a film failure in the first couple of connection makes and breaks. It is also possible, however, that samples pulled from other threaded connections may have had harder formation residues that could have resulted in an earlier failure. It is likely that the thread residues varied widely throughout the string with regard to mud content, cutting types, etc.

The data primarily showed that regardless of base grease type many of the thread compound properties are affected by the degree of mud contamination. The more mud, the more the properties are affected calling form more strict control of how much mud is allowed to be mixed into the threaded connection during doping. For easy drilling applications, this may not be as large a concern. For more severe applications such as high angle or highly deviated drilling, deeper hotter holes, higher rotary table speeds, etc. the wide spread in frictional properties from about 1.06 to about 0.75 with varying levels of contamination make proper connection make-up a difficult.

The data from these test is shown below:

| Samples | Dropping Pt. (° C.) | Brookfield | Pen @ 25° C. | Density | Post 110° C. Pen or Brookfield @ 25° C. | 4-Ball Weld Pt. | Friction Factor by Slope | Friction Factor by Turns | Breakout Torque divided by Makeup Torque |
|---|---|---|---|---|---|---|---|---|---|
| KK Thread Sample | <130 | | >400 | 11.9 | | 315 | 0.75 | 0.77 | 0.50 |
| KKLC | 301 | | 323 | 9.70 | 315 | 1000 | 101 | 1.04 | 0.72 |
| KKLC-10% Mud | | | 299 | 10.25 | 297 | 1000 | | | |
| KKLC-20% Mud | | | 312 | 10.60 | 301 | 800 | | | |
| KKLC-50% Mud | 183 | | 374 | 11.75 | 336 | 500 | 096 | 0.92 | 0.65 |
| KK CAB | >330 | | 315 | 9.80 | 300 | 800 | 1.01 | 1.06 | 0.71 |
| KK CAB-10% Mud | | | 287 | 10.55 | 269 | 800 | 1.01 | 1.04 | 0.72 |
| KK CAB-20% Mud | | | 311 | 11.05 | 201 | 800 | 1.02 | 1.01 | 0.71 |
| KK CAB-50% Mud | | 49,000 | 347 | 12.25 | 323 | 400 | 1.01 | 0.95 | 0.68 |
| KK DBC | >330 | | 328 | 10.25 | | 100 | | | |
| KK DBC-10% Mud | | | 338 | 10.8 | | | | | |
| KK DBC-20% Mud | | | 347 | 11.15 | 57,000 | | | | |
| KK DBC-50% Mud | 146 | | 367 | 12.3 | 24,000 | 620 | | | |
| KK Std. | 267 | | | | | 1000 | 1.00 | 1.00 | 0.70 |
| KK Std.-10% Mud | | | 280 | 9.75 | 80,000 | 800 | 0.97 | 1.01 | 0.70 |
| KK Std.-20% Mud | | | 275 | 10.25 | 8,000 | 620 | 0.95 | 0.80 | 0.70 |
| KK Std.-50% Mud | 136 | | 328 | 11.75 | 2,000 | 400/315 | 0.92 | 0.94 | 0.64 |
| KK Std.-65% Mud | | | 348 | 12.0 | | 315 | 0.79 | 0.87 | 0.60 |
| *KK-pH 8 Mud 20% | | | 312 | 10.60 | 335 | 800 | | | |
| *KK-pH 8 Mud 50% | | | 377 | 11.75 | 3600 cP | 400 | | | |
| KK Castor Oil | 286 | | 314 | 9.85 | 280 | 1000 | | | |

-continued

| Samples | Dropping Pt. (° C.) | Brookfield | Pen @ 25° C. | Density | Post 110° C. Pen or Brookfield @ 25° C. | 4-Ball Weld Pt. | Friction Factor by Slope | Friction Factor by Turns | Breakout Torque divided by Makeup Torque |
|---|---|---|---|---|---|---|---|---|---|
| KK Castor Oil-10% Mud | | | 300 | 10.55 | 274 | 1000 | 0.96 | 0.95 | 0.65 |
| KK Castor Oil-20% Mud | | | 314 | 10.65 | 313 | 800 | 0.95 | 0.88 | 0.62 |
| KK Castor Oil-50% Mud | | 46,000 | | 11.6 | 8,000 | 620 | 0.90 | 0.83 | 0.60 |

*The drilling mud was at pH 9.5-10.0 except where noted with an asterisk. The 8.5 pH was prepared by adding a small quantity of Acetic Acid.

The above data clearly evidences the superior properties of calcium sulfonate based grease for use as a carrier for controlled friction thread compounds. The surprisingly improved properties of the calcium sulfonate based greases in comparison to other convention grease was both unexpected and represented a set of compounds that are stable under the conditions of continuous, periodic or intermittent exposure to fluids that tend to contamination, erode, ablate or otherwise remove or interfere with the compounds ability to protect contact surfaces.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method for using a calcium sulfonate complex grease based composition to protect contacting surfaces comprising the steps of:

applying to the contacting surfaces exposed on a continuous, periodic and/or intermittent basis to an active fluid, prior to engaging the surfaces, an amount of a thread composition comprising a calcium sulfonate complex grease and a thread protecting additive system; and engaging the contacting surfaces, and exposing the contacting surfaces to the active fluid having a pH greater than or equal to 7 on a continuous, periodic and/or intermittent basis, where the amount of the composition is sufficient to protect the contacting surfaces from direct metal-to-metal contact during the exposing step.

2. The method of claim 1, wherein the grease comprises from about 20 wt. % to about 60 wt. % of the calcium sulfonate complex grease and from about 10 wt. % to about 60 wt. % of the thread protecting additive system.

3. The method of claim 1, wherein the composition further includes an anti-wear additive system and/or an anti-degradant system and the thread protecting additive system compnses one or more boundary lubricants and/or one or more contacting surface protecting agent.

4. The method of claim 3, wherein the composition comprises from about 40% to about 80% by weight of the calcium sulfonate complex grease, from about 5% to about 60% by weight of one or more boundary lubricants and from about 0.1% to about 10% by weight of one or more contacting surface protecting agent.

5. The method of claim 3, wherein the composition comprises from about 40% to about 80% by weight of the calcium sulfonate complex grease, from about 5% to about 60% by weight of one or more boundary lubricants and from about 0.1% to about 10% by weight of one or more contacting surface protecting agent and further comprises up to about 12% by weight of an anti-wear additive system and up to about 5% by weight of an anti-degradant system.

6. The method of claim 4, wherein the composition comprises from about 50% to about 80% by weight of the calcium sulfonate complex grease, from about 10% to about 30% by weight of one or more boundaiy lubricants, and from about 0.2% to about 5% by weight of contacting surface protecting agent, up to about 10% by weight an anti-wear additive system and up to about 4% by weight of an anti-degradant system.

7. The method of claim 1, wherein the calcium sulfonate complex grease comprises calcium sulfonate dispersed in a base oil.

8. The method of claim 7, wherein calcium sulfonate complex grease comprises from about 5 to about 40 wt. % calcium sulfonate and from about 95 to about 60 wt. % base oil based on the total weight of the grease.

9. The method of claim 7, wherein calcium sulfonate complex grease comprises from about 10 to about 30 wt. % calcium sulfonate and from about 90 to about 70 wt. % base oil based on the total weight of the grease.

10. The method of claim 7, wherein the base oil is selected from the group consisting of synthetic fluids, petroleum fluids, natural fluids, and mixtures or combinations thereof and has a viscosity ranging from about 5 to about 600 centistokes at 40° C. centigrade.

11. The method of claims 1, wherein the composition is an anti-seize thread compound.

12. A method for using a calcium sulfonate complex greased based composition to protect threaded connections comprising the steps of:

applying to threads of a threaded connection to be exposed on a continuous, periodic and/or intermittent basis to an active fluid, prior to making up the connection, an amount of a thread composition comprising a calcium sulfonate complex grease and an additive system; and making-up the threaded connection, and exposing the threaded connection to the active fluid having a pH greater than or equal to 7 on a continuous, periodic and/or intermittent basis, where the amount of the composition is sufficient to protect the connection from direct metal-to-metal contact during the exposing step.

13. The method of claim 12, wherein the grease comprises from about 40 wt. % to about 95 wt. % of the calcium sulfonate complex grease and from about 60 wt. % to about 5 wt. % of the additive system.

14. The method of claim 12, wherein the additive system comprises one or more boundary lubricants, one or more contacting surface protecting agents, one or more an anti-wear additives and/or one or more an anti-degradants.

15. The method of claim 14, wherein the composition comprises from about 40% to about 80% by weight of the calcium sulfonate complex grease, from about 5% to about 60% by weight of one or more boundary lubricants and from about 0.1% to about 10% by weight of one or more contacting surface protecting agent.

16. The method of claim 14, wherein the composition comprises from about 40% to about 80% by weight of the calcium sulfonate complex grease, from about 5% to about 60% by weight of one or more boundary lubricants and from about 0.1% to about 10% by weight of one or more contacting surface protecting agent and further comprises up to about 12% by weight of an anti-wear additive system and up to about 5% by weight of an anti-degradant system.

17. The method of claim 12, wherein the calcium sulfonate complex grease compnses from about 5 to about 40 wt. % calcium sulfonate and from about 95 to about 60 wt. % base oil based on the total weight of the grease.

18. The method of claim 1 wherein calcium sulfonate complex grease comprises from about 10 to about 30 wt. % calcium sulfonate and from about 90 to about 70 wt. % base oil based on the total weight of the grease.

19. The method of claim 9, wherein the base oil is selected from the group consisting of synthetic fluids, petroleum fluids, natural fluids, and mixtures or combinations thereof and has a viscosity ranging from about 5 to about 600 centistokes at 40° C. centigrade.

20. The method of claims 12, wherein the composition is an anti-seize thread compound.

21. The method of claims 1, wherein the active fluid has a pH greater than or equal to 8.

22. The method of claims 1, wherein active fluid has a pH greater than or equal to 9.

23. The method of claims 12, wherein the active fluid has a pH greater than or equal to 8.

24. The method of claims 12, wherein active fluid has a pH greater than or equal to 9.

25. The method of claims 1, wherein the composition further comprises:

a finely divided fibrous material.

26. The method of claims 1, wherein the composition further comprises:

a metal powder and/or flake.

27. The method of claims 12, wherein the composition further comprises:

a finely divided fibrous material.

28. The method of claims 12, wherein the composition further comprises:

a metal powder and/or flake.

* * * * *